US011596272B1

(12) United States Patent
Wu et al.

(10) Patent No.: US 11,596,272 B1
(45) Date of Patent: Mar. 7, 2023

(54) SHOWER BAR SYSTEM FOR LIQUID SOAP SUPPLY

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Peng-Wei Xie, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 17/588,445

(22) Filed: Jan. 31, 2022

(51) Int. Cl.
*F16M 13/02* (2006.01)
*A47K 5/12* (2006.01)

(52) U.S. Cl.
CPC ..... *A47K 5/1215* (2013.01); *A47K 5/1209* (2013.01)

(58) Field of Classification Search
CPC .... A47K 5/1215; A47K 5/1209; E03C 1/046; E03C 1/06; E03C 1/063; E03C 1/066; Y10T 137/0335
See application file for complete search history.

(56) References Cited

U.S. PATENT DOCUMENTS 4,085,867 A * 4/1978 Heller ..... A47K 5/122 248/222.51
6,012,613 A * 1/2000 Chen ..... A47K 5/1208 222/476
6,926,212 B1 * 8/2005 Glass ..... E03C 1/046 239/320
7,458,112 B1 * 12/2008 Yang ..... E03C 1/06 4/570
2005/0150909 A1 * 7/2005 Leonard ..... E03C 1/046 222/527
2009/0272449 A1 * 11/2009 Craig ..... B01F 25/316 137/897
2010/0213279 A1 * 8/2010 Frederick ..... B05B 7/2464 222/23
2012/0240327 A1 * 9/2012 Stimpson ..... A47K 3/003 4/605
2019/0085540 A1 * 3/2019 Thadhani ..... E03C 1/0408
2019/0301147 A1 10/2019 Wu et al.

FOREIGN PATENT DOCUMENTS

EP 1428942 A2 * 6/2004 ..... A47K 3/281
EP 1602787 A2 * 12/2005 ..... A47K 5/04
FR 2518505 A1 * 6/1983
KR 10-2010-0092627 A 8/2010

* cited by examiner

*Primary Examiner* — Bob Zadeh
(74) *Attorney, Agent, or Firm* — Birch, Stewart, Kolasch & Birch, LLP

(57) ABSTRACT

A shower bar system for liquid soap supply comprises a soap dispenser assembly, a fixed base, a slide bar which is connected between the two, and an accessory which is coupled to the slide bar. The soap dispenser assembly includes a soap dispensing mechanism and two pivot mechanisms which are disposed respectively at the left side and the right side of the soap dispensing mechanism. Each of the pivot mechanisms is rotatably coupled to a rotary unit. An inner end of each of the rotary units has a connecting opening communicating with the soap dispensing mechanism. A peripheral surface of each of the rotary units is detachably coupled to a soap bottle. The liquid soap flown from each soap bottle to the soap dispenser assembly can be pressed out through the soap dispensing mechanism.

10 Claims, 10 Drawing Sheets

SHOWER BAR SYSTEM FOR LIQUID SOAP SUPPLY

BACKGROUND OF THE INVENTION

Technical Field

The present invention generally relates to a bathroom device, and more particularly to a shower bar system for liquid soap supply.

Description of Related Art

The existing shower bar system is mounted on the wall of the bathroom, in which there is a slide bar coupled between an upper fixed base and a lower fixed base, or coupled between a faucet and a fixed base above the faucet. By combining the slide bar with the bathroom accessories such as a platform or a shower bracket, bath or shampoo bottles can be placed on the platform or a showerhead can be hung on the shower bracket.

However, such shower bar systems provide a platform to place bath or shampoo bottles only. When bath gels or shampoo are to be used, the bottles need to be placed on the platform first, and then the bath gels or shampoo are taken from the bottles. Those bottles placed on the platform are easy to fall due to a bump and do not have a beautiful appearance design, which needs to be further improved.

BRIEF SUMMARY OF THE INVENTION

In view of the above, the primary objective of the present invention is to provide a shower bar system with a rotatable rotary unit for soap bottle setting, achieving a dual function of soap supply and accessories setting. When using the shower bar system, the soap bottle can be coupled to the rotary unit with the bottle mouth facing upward and then turned to an upside-down state of use. Thereby, a user can easily refill the soap bottle.

The present invention provides a shower bar system for liquid soap supply comprising a soap dispenser assembly and a shower bar assembly which is connected to the soap dispenser assembly. The soap dispenser assembly includes a soap dispensing mechanism, a first fixed structure, a rotary unit, and a soap bottle. The soap dispenser assembly has a lateral hole positioned on at least one side of a left side and a right side. The lateral hole is provided with a pivot mechanism rotatably coupled to the rotary unit. A peripheral surface of the rotary unit has a soap bottle joint opening. A side of the rotary unit facing the lateral hole has a connecting opening communicating with the soap bottle joint opening and the soap dispensing mechanism. The soap bottle containing liquid soap is detachably coupled to the soap bottle joint opening.

The shower bar assembly includes a fixed base, a slide bar, and an accessory. The fixed base has a second fixed structure. The slide bar is connected between the soap dispenser assembly and the fixed base, and the accessory is coupled to the slide bar.

Preferably, the soap dispenser assembly further includes a casing and a valve core. The valve core is disposed inside the casing, and the first fixed structure is disposed at a rear end of the casing. The valve core has a side hole corresponding to the lateral hole and positioned on at least one side of a left side and a right side of the valve core. The connecting opening of the rotary unit is in sealing communication with the side hole of the valve core. A front surface of the valve core has at least one front hole communicating with the side hole. The soap dispensing mechanism which is disposed in the casing includes a temporary soap chamber therein, a first check valve, a pressing member, and a second check valve. The temporary soap chamber corresponds to the front hole. The first check valve is located between the temporary soap chamber and the front hole. The pressing member corresponds to the temporary soap chamber. When the pressing member is pressed, it compresses the temporary soap chamber to output liquid soap in the temporary soap chamber from a liquid outlet. After the pressing member is not pressed, the temporary soap chamber returns to an original position. The second check valve is located between the liquid outlet and the temporary soap chamber.

Preferably, the soap dispensing mechanism includes a compressing member corresponding to the front hole. The compressing member is an elastomer and has a temporary soap chamber therein. A periphery of a front end of the compressing member forms a flange portion. The second check valve is connected to the middle of the front end of the compressing member. The pressing member has a front diversion hole therein, and the front diversion hole has a rear end and a bottom end. The rear end of the front diversion hole is sleeved on the second check valve and abuts against the flange portion. The bottom end of the front diversion hole is connected to a liquid outlet tube. The liquid outlet is positioned at a bottom of the liquid outlet tube.

A top surface and a bottom surface of the valve core have a fastening slot respectively. The front hole has a front section and a rear section, in which the front section forms an accommodating section and a diameter of the accommodating section is greater than that of the rear section. The first check valve is disposed in the accommodating section. A rear end of the first check valve has an annular flange abutting against a periphery of a rear end of the accommodating section. The soap dispensing mechanism includes a rear fastening member having a rear plate and two rear hooks. The rear plate abuts against the front surface of the valve core and has a rear through hole corresponding to the front hole. A periphery of the rear through hole extends backward to form a rear tube passing through the accommodating section and abutting against the annular flange with an end of the rear tube so that the first check valve is fastened in the accommodating section. The two rear hooks are connected respectively to a top edge and a bottom edge of the rear plate and extend backward respectively. The two rear hooks hook on the two fastening slots respectively.

A rear end of the compressing member is an open end and has a cover plate protruding toward around. The cover plate sealing covers the rear plate so that the rear through hole communicates with the temporary soap chamber. The soap dispensing mechanism includes a front fastening member having a front plate and two front hooks. The front plate abuts against a front surface of the cover plate and has a front through hole corresponding to the compressing member so that the compressing member passes forward through the front through hole. The two front hooks are connected respectively to a top edge and a bottom edge of the front edge and extend backward respectively. The two front hooks hook on the two fastening slots respectively.

Preferably, the pressing member includes a front diversion member and a button which is sleeved on the front diversion member. The front diversion member includes the front diversion hole and an abutting flange which is at a back of the front diversion hole. The abutting flange surrounds a periphery of the rear end of the front diversion hole and abuts the flange portion.

Preferably, the casing includes a tube body and a vertical tube which is connected to a front end of the tube body. The tube body extends forward and backward and has the lateral hole. The valve core and the soap dispensing mechanism are respectively disposed in the tube body. The vertical tube is vertically arranged. An inside of the vertical tube communicates with an inside of the tube body. A front surface of the vertical tube has at least one button through hole. The button passes forward through the at least one button through hole. A bottom end of the liquid outlet tube extends and abuts a bottom end of the vertical tube.

Preferably, a part of the tube body located behind the lateral hole has at least one button hole. A rear end of the tube body is sleeved on a positioning seat. An outline of a peripheral surface of the positioning seat conforms to an outline of an inner wall of the rear end of the tube body. The first fixed structure is a fastening hole which passes through the positioning seat. The positioning seat is provided with at least one flexible button which is inserted into the button hole so that the positioning seat is positioned inside the rear end of the tube body.

Preferably, the fixed base is positioned above the soap dispenser assembly. The second fixed structure is a fastening hole. The slide bar is connected between the fixed base and the vertical tube.

The pivot mechanism has a fastening ring fixedly embedded in the lateral hole. The fastening ring has a tube through hole positioned at a middle of the fastening ring. The fastening ring includes two lateral hooks which are positioned respectively at two opposite sides of a periphery of the tube through hole and extend outward respectively. The rotary unit includes a rotating casing and a side diversion member. A side of the rotating casing facing the lateral hole has a lateral opening. A periphery of the rotating casing forms a tubular member which has an inner threaded section on an inner wall of the tubular member. The soap bottle joint opening is formed on an inner side of the inner threaded section. The side diversion member is fixed in the rotating casing and has a shaft tube which extends toward the lateral hole and passes through the lateral opening. The side diversion member has a side diversion hole. One end of the side diversion hole communicates with the soap bottle joint opening. The side diversion hole extends to the shaft tube and the other end of the side diversion hole forms the connecting opening at an outer end of the shaft tube. The shaft tube passes through the tube through hole to rotatably insert into the side hole of the valve core. The shaft tube has an annular groove which is formed at an outer peripheral surface of a part of the shaft tube that is not inserted into the side hole. The two lateral hooks of the pivot mechanism hook on the annular groove.

Preferably, the soap bottle has a bottle body and a bottleneck which is connected to the bottle body. An outer peripheral surface of the bottleneck forms an outer threaded section which is screwed to the inner threaded section and is fastened.

The advantage of the present invention is that with the soap dispenser assembly and the slide bar for accessory setting, a dual function of a soap dispensing device and a shower bar is provided. Meanwhile, an integrated appearance is more beautiful. Since the rotary unit for combining the soap dispenser assembly and the soap bottle is rotatable, when refilling the liquid soap, the rotary unit is rotated to a position where the soap bottle joint opening faces down. Whereby, the soap bottle can be coupled to the rotary unit with the bottle mouth facing upward. Then, the soap bottle together with the rotary unit is rotated to an upside-down position where the liquid soap in the soap bottle can flow down smoothly. Since the liquid soap does not overflow during the above-mentioned installation process, it is possible to avoid the waste of liquid soap loss or a messy environment, which is easy for the user to refill the liquid soap.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
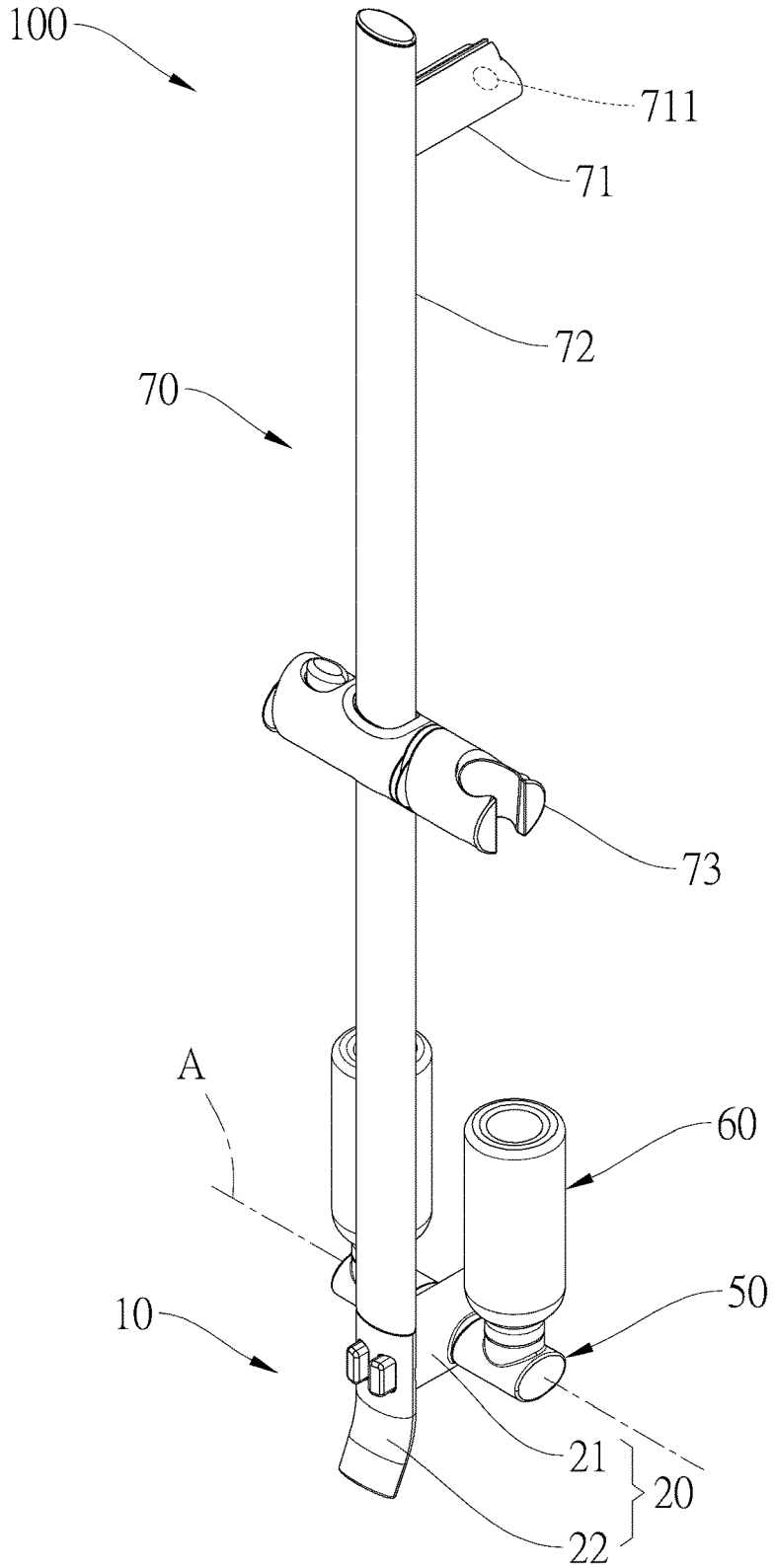
FIG. 1 is a perspective view of a preferred embodiment according to the present invention.
Figure 2:
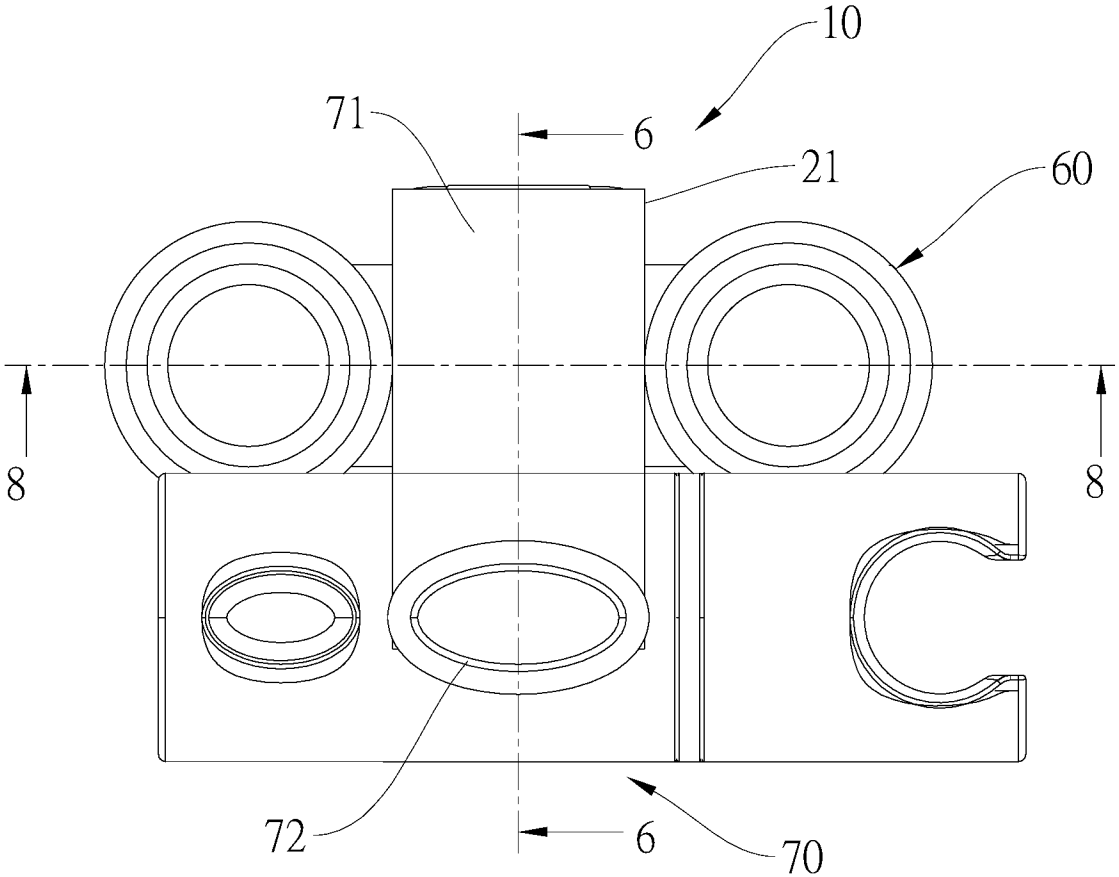
FIG. 2 is a top view of the preferred embodiment.
Figure 3:
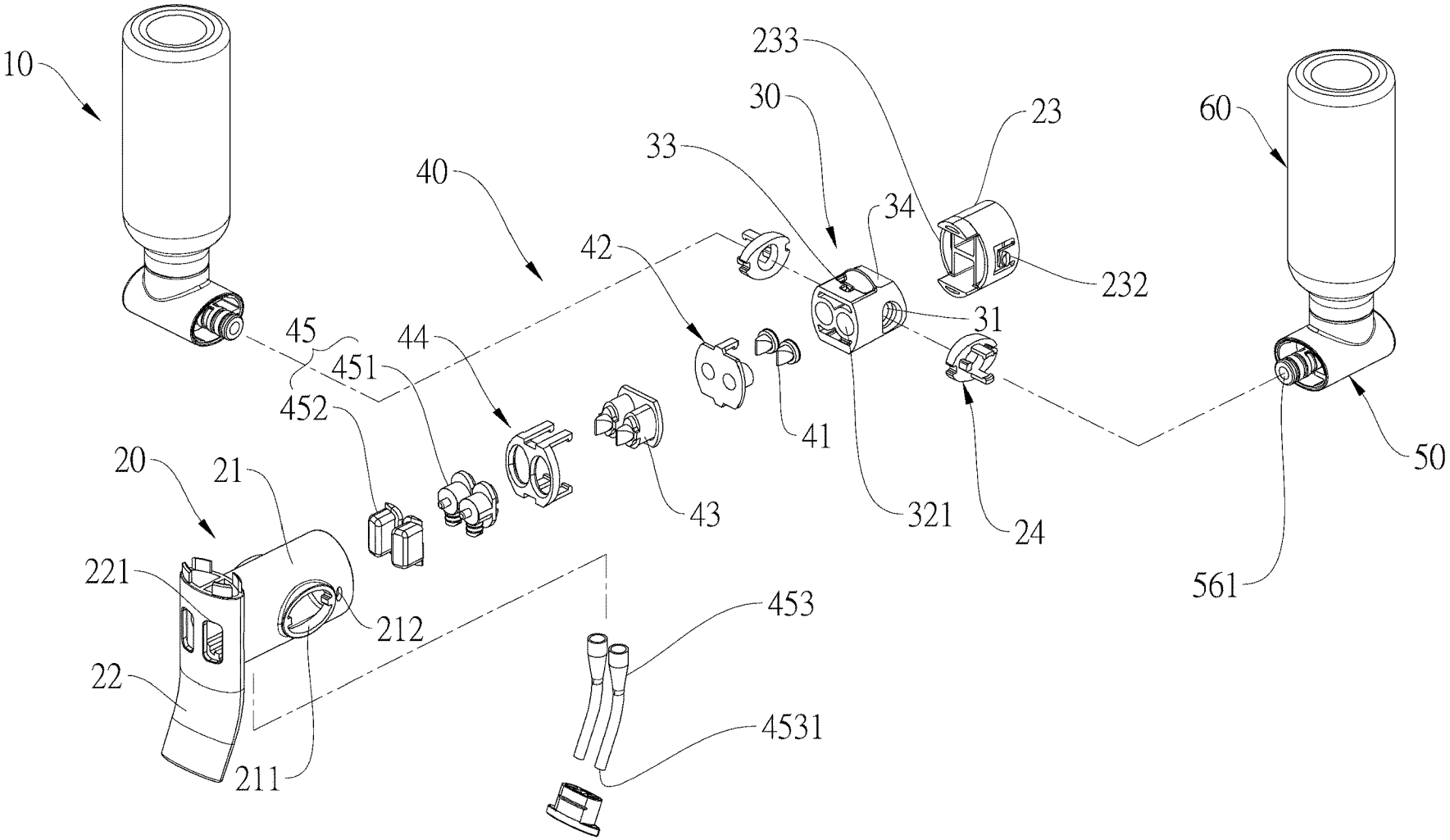
FIG. 3 is an exploded view of a soap dispenser assembly of the preferred embodiment.
Figure 4:
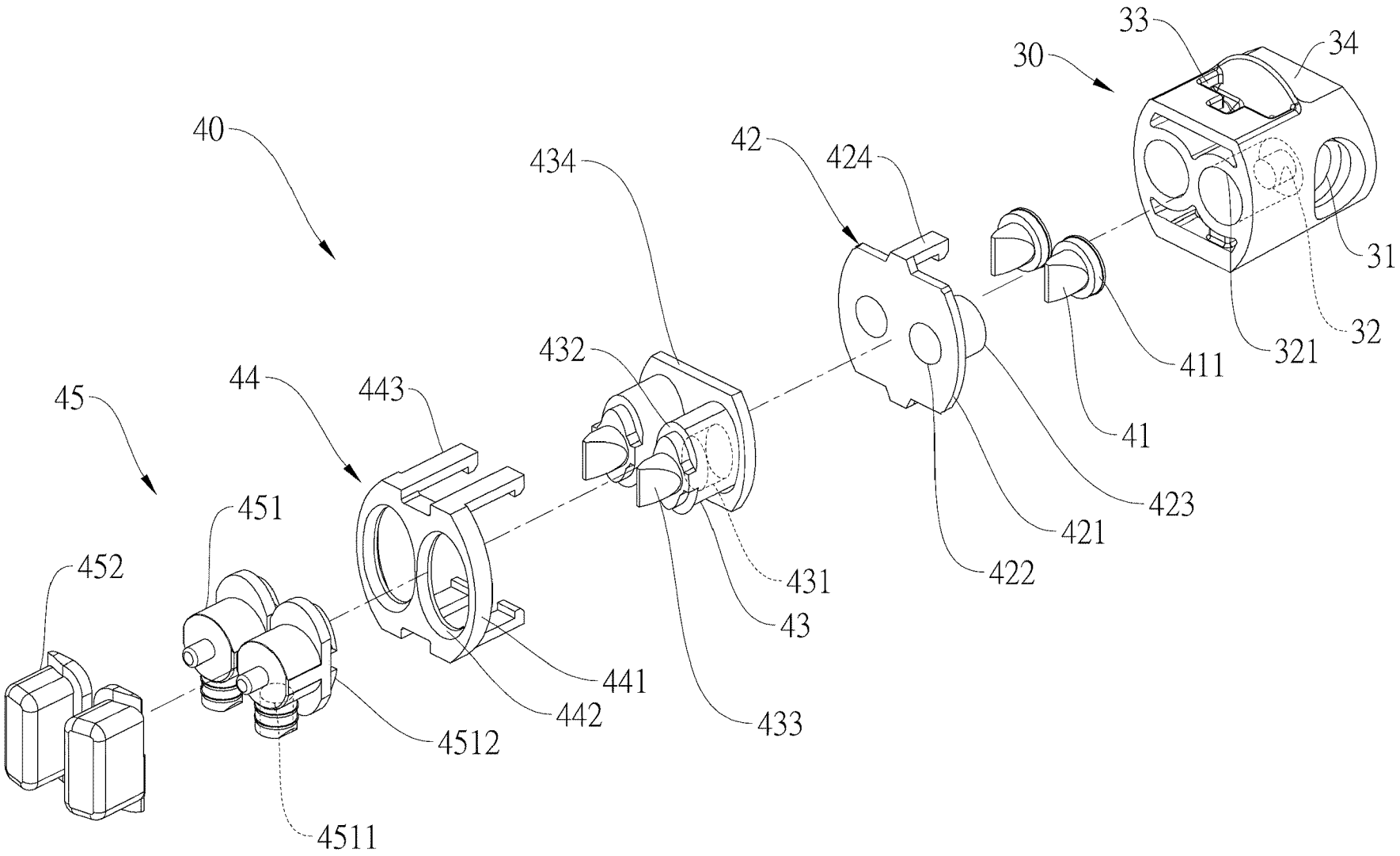
FIG. 4 is an exploded view of a valve core and a soap dispensing mechanism of the preferred embodiment.
Figure 5:
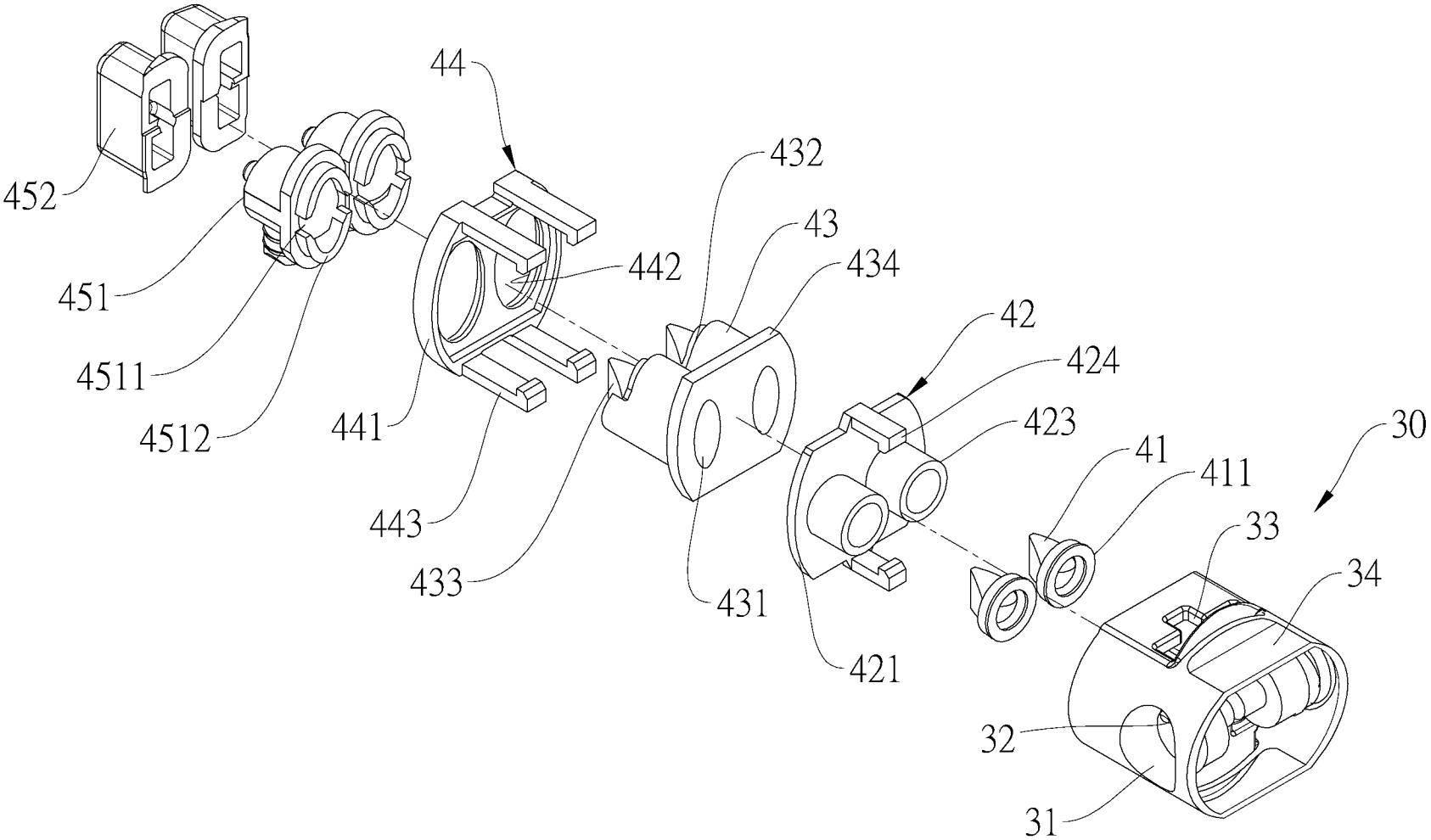
FIG. 5 is another exploded view of FIG. 4.
Figure 6:
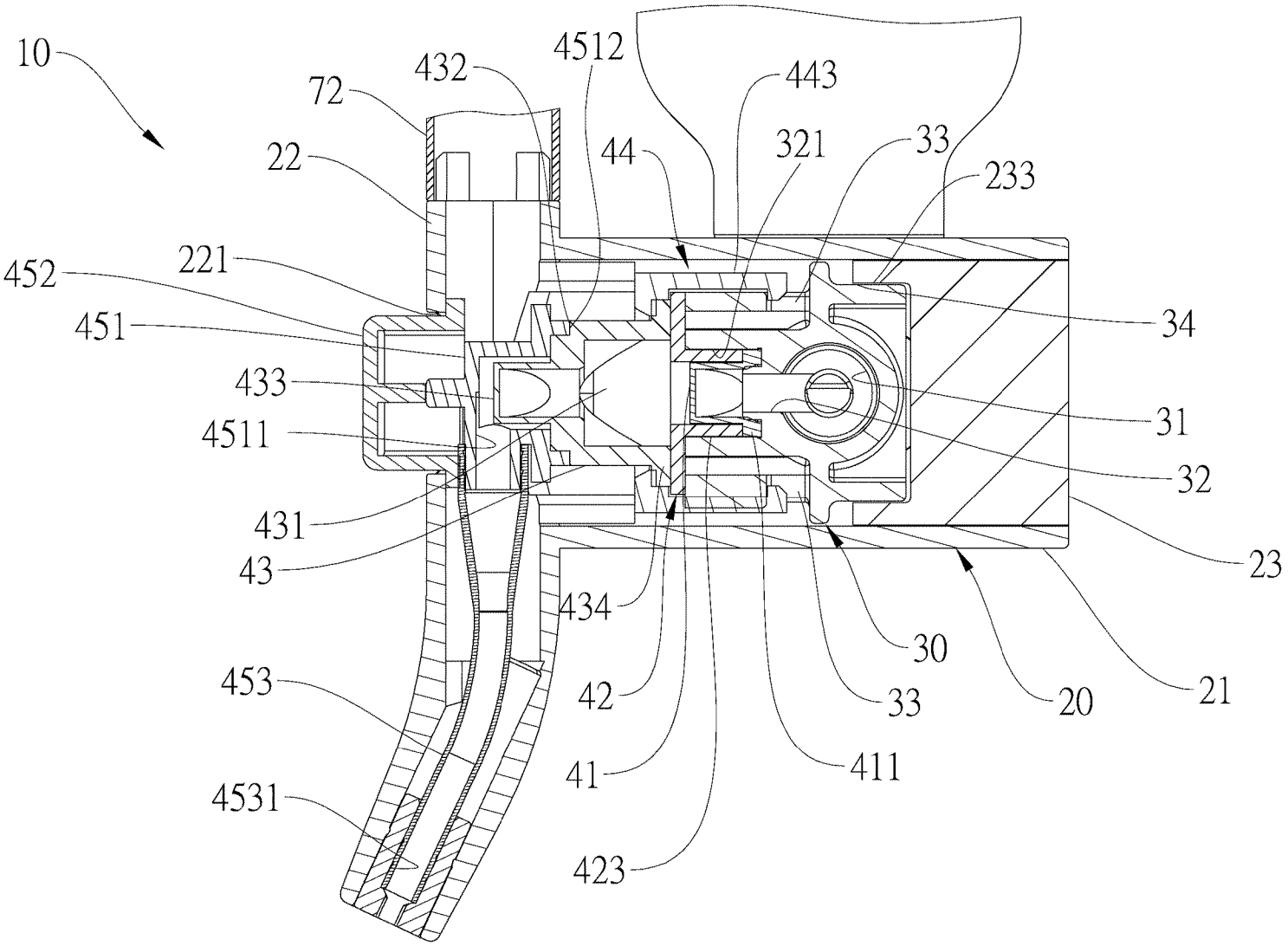
FIG. 6 is a longitudinal sectional view of the soap dispenser assembly of the preferred embodiment.

The following illustrative embodiments and drawings are provided to illustrate the disclosure of the present invention, these and other advantages and effects can be clearly understood by persons skilled in the art after reading the disclosure of this specification.

A shower bar system 100 of a preferred embodiment according to the present invention is shown in FIG. 1 to FIG. 9. The shower bar system 100 includes a soap dispenser assembly 10 and a shower bar assembly 70 which is connected to the soap dispenser assembly 10

The soap dispenser assembly 10 includes a casing 20, a valve core 30, a soap dispensing mechanism 40, two rotary units 50, and two soap bottles 60. A rear end of the casing is provided with a first fixed structure 231. The first fixed structure 231 includes at least one fastening hole, which is two fastening holes in the current preferred embodiment. The casing 20 includes two lateral holes 211 respectively positioned at a left side and a right side of the casing 20. Both the two lateral holes 211 are non-circular holes and are respectively provided with a pivot mechanism 24.

The valve core 30 is disposed inside the casing 20 and has two side holes 31 which respectively correspond to each of the lateral holes 211 and are respectively positioned at a left side and a right side of the valve core 30. A front surface of the valve core 30 has two front holes 32 which are respectively positioned at a left side and a right side thereof. Each of the front holes 32 communicates with each of the side holes 31.

The soap dispensing mechanism 40 is disposed in the casing 20 and is connected to a front side of the valve core 30. The soap dispensing mechanism 40 includes two temporary soap chambers 431 therein which respectively correspond to each of the front holes 32. There is a first check valve 41 located between each of the temporary soap chambers 431 and each of the front holes 32. Each of the temporary soap chambers 431 is provided with one pressing member 45. When each of the pressing members 45 is pressed, it compresses each of the temporary soap chambers 431 to output liquid soap in the temporary soap chamber 431 from a liquid outlet 4531. After the pressing member 45 is not pressed, the temporary soap chamber 431 returns to an original position. There is one second check valve 433 located between each of the liquid outlets 4531 and each of the temporary soap chambers 431.

Figure 7:
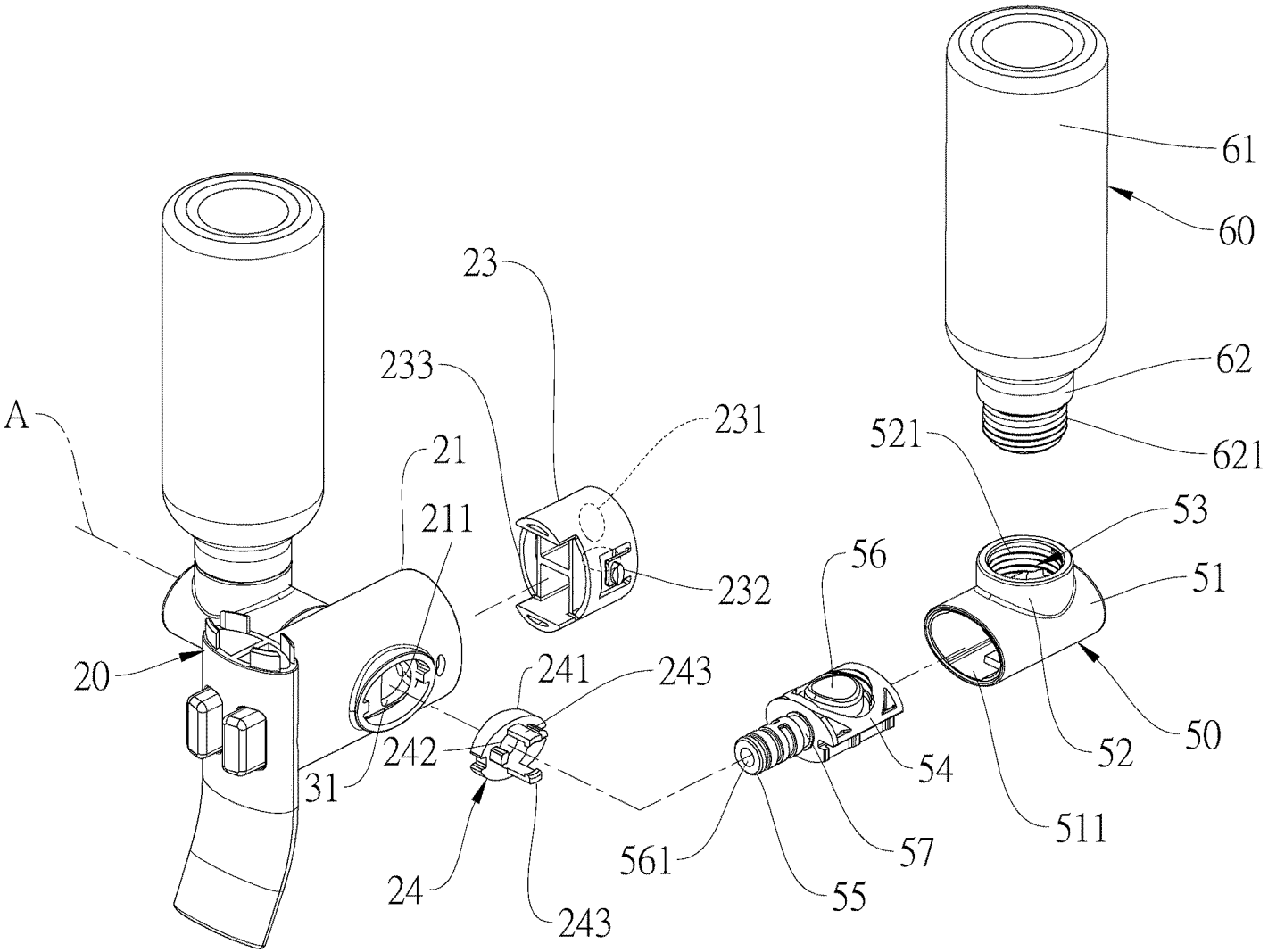
FIG. 7 is an exploded view of a part of a rotary unit of the preferred embodiment.

The two rotary units 50 are rotatably coupled to the two pivot mechanisms 24 respectively. Each of the rotary units 50 rotates along an axis of rotation A which passes through each of the rotary units 50. As shown in FIG. 7, the axis of rotation A is a long axis extending in a left-right direction and the axis of rotation A passes through a center of each of the side holes 31. A peripheral surface of each of the rotary units 50 has a soap bottle joint opening 53. A side of each of the rotary units 50 facing each of the lateral holes 211 has a connecting opening 561. Each of the connecting openings 561 is in sealing communication with each of the side holes 31 of the valve core 30. The two soap bottles 60 for containing liquid soap are respectively detachably coupled to each of the soap bottle joint openings 53.

As shown in FIG. 1, the shower bar assembly 70 includes a fixed base 71, a slide bar 72, and an accessory 73. A rear end of the fixed base 71 has a second fixed structure 711 which is a fastening hole in the current preferred embodiment. The slide bar 72 is a long straight rod and is connected between the casing 20 of the soap dispenser assembly 10 and the fixed base 71 of the shower bar assembly 70. In the current preferred embodiment, the accessory 73 is a shower bracket coupled to the slide bar 72 for a showerhead to be hung on. The accessory 73 serving as a shower bracket can be adjusted a height position of the accessory 73 coupled to the slide bar 72. In other preferred embodiments, the accessory 73 can be a hanging basket, a platform, or a top showerhead which is coupled to a top of the slide bar 72.

As shown in FIG. 1 to FIG. 6, when using the present invention, the liquid soap such as soap, hand lotion, shower gel, or shampoo are stored in each of the soap bottles 60. When using the liquid soap to clean hands or a body, a user presses each of the pressing members 45 so that the pressing members 45 compress each of the temporary soap chambers 431 to output the liquid soap in each of the temporary soap chambers 431 flown through the second check valve 433 to each of the liquid outlets 4531 to be used. Then, the user releases each of the pressing members 45, and each of the pressing members 45 returns to an original position. Vacuum suction is generated in the process of each of the temporary soap chambers 431 returning to its original position so that the liquid soap in each of the soap bottles 60 is sucked into each of the temporary soap chambers 431 through each of the connecting openings 561 of each of the rotary units 50, each of the side holes 31, and each of the first check valves 41 and is ready for use.

Figure 9:
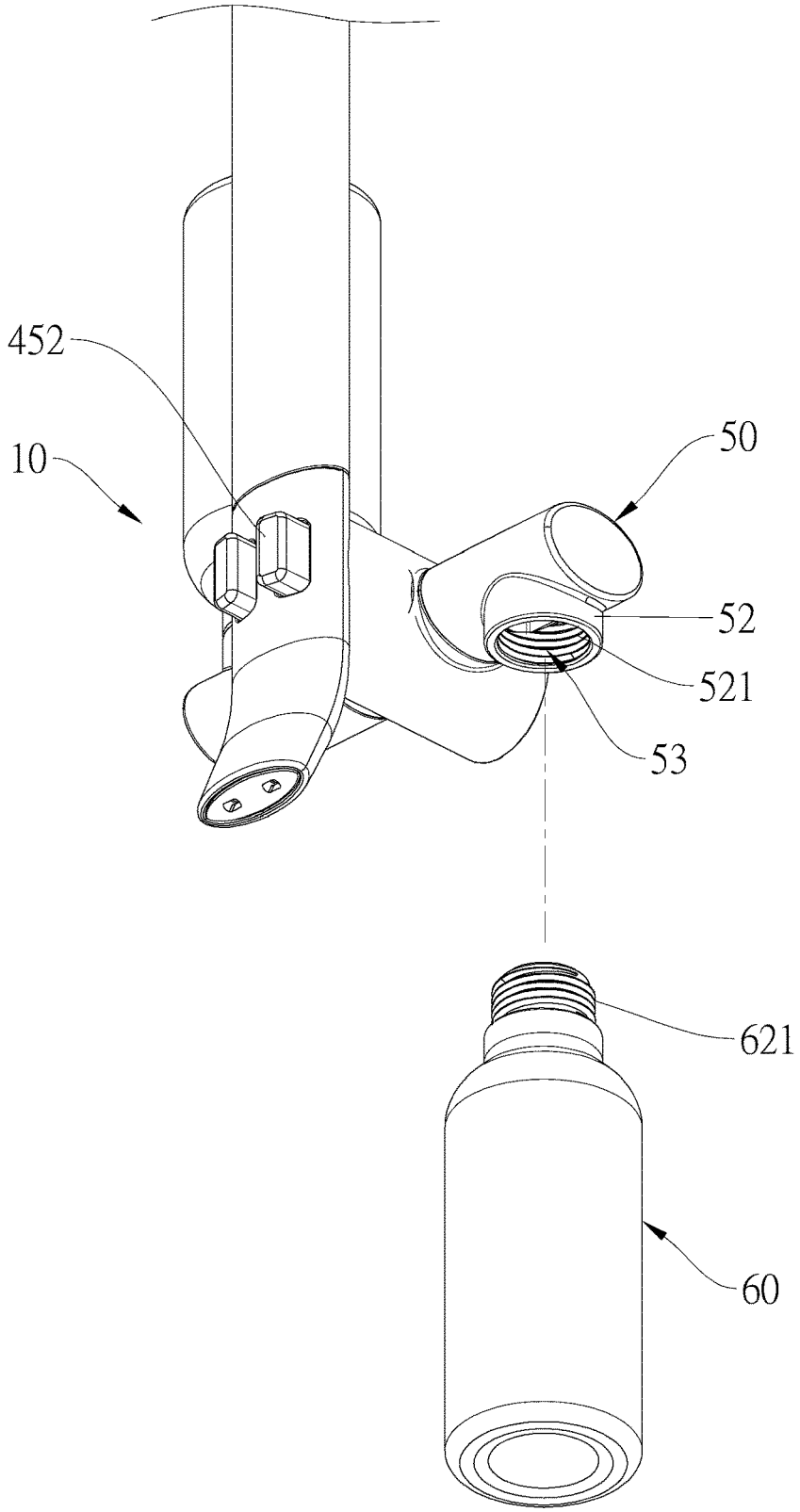
FIG. 9 is a schematic view showing replacing a soap bottle of the preferred embodiment.
Figure 10:
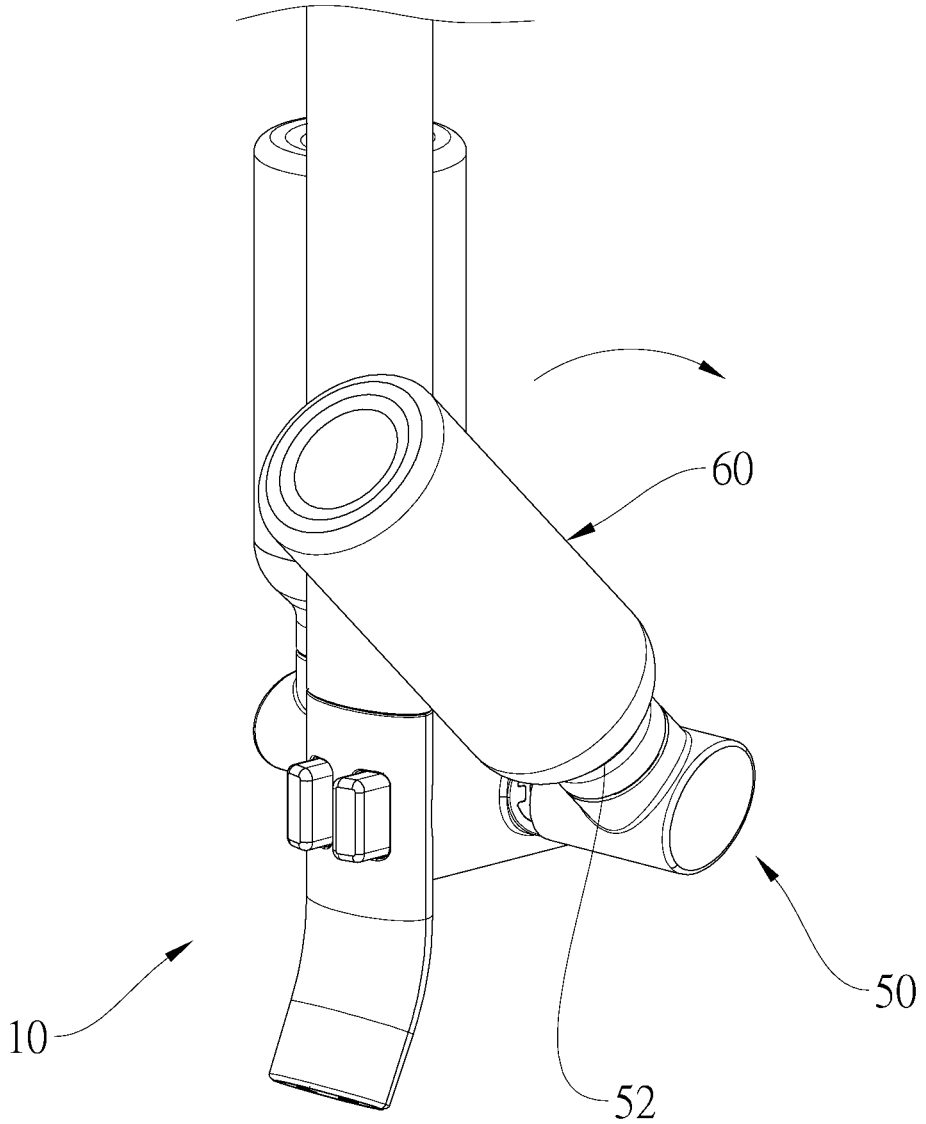
FIG. 10 is a schematic view showing that the soap bottle is rotated to an upside-down state of the preferred embodiment.

As shown in FIG. 9 and FIG. 10, when the liquid soap in each of the soap bottles 60 is used up and needs to be refilled or a new soap bottle 60 needs to be replaced, first rotate each of the rotary units 50 to a position where each of the soap bottle joint openings 53 faces down. After detaching each of the soap bottles 60 from each of the soap bottle joint openings 53, have each of the soap bottles 60 containing the liquid soap with the bottle mouths facing upwards to be coupled to each of the soap bottle joint openings 53 of each of the rotary units 50. Finally, rotate each of the soap bottles 60 together with each of the rotary units 50 to a position where the soap bottles 60 are upside-down so that the liquid soap in each of the soap bottles 60 can smoothly flow out to each of the soap bottle joint openings 53 of each of the rotary units 50 under the gravity action. That is, the installation work of each of the soap bottles 60 is completed.

In the above-mentioned preferred embodiment, the two lateral holes 211 are respectively positioned at the left side and the right side of the casing 20 and are respectively provided with a pivot mechanism 24. In another preferred embodiment, a lateral hole 211 can be provided at only one of the left side and the right side of the casing 20 and is provided with the above-mentioned pivot mechanism 24. And, one rotary unit 50 is then rotatably coupled to the pivot mechanism 24.

With the only one rotary unit 50 as mentioned above, the valve core 30 has one side hole 31 positioned at one of the left side and the right side of the valve core 30. The side hole 31 and the connecting opening 561 of the rotary unit 50 are in sealing communication. The front surface of the valve core 30 has only one front hole 32 communicating with the side hole 32. The soap dispensing mechanism 40 includes a temporary soap chamber 431 which corresponds the only one front holes 3, a first check valve 41, a pressing member 45 which returns to an original position after pressed, a liquid outlet 4531, and a second check valve 433. The components of the soap dispensing mechanism 40 have the same combination and operation as those described in the above preferred embodiment.

The detailed structure of the soap dispenser assembly 10 of the above preferred embodiment is to be further illustrated, which is an example that the soap dispenser assembly 10 includes two rotary units 50 respectively positioned at the left side and the right side of the soap dispenser assembly 10. Besides, in the above-mentioned another embodiment, the shower bar system 100 can include the shower bar assembly 70 and one soap dispenser assembly 10 which is positioned at only one of the left side and the right side of the casing 20. The soap dispenser assembly 10 includes one rotary unit 50 and one soap bottle 60. In combination with one valve core 30 and one soap dispensing mechanism 40, the soap dispenser assembly 10 with a single rotary unit 50 can be formed.

The detailed structure of the soap dispenser assembly 10 of the above preferred embodiment is to be further illustrated, which is an example that the soap dispenser assembly 10 includes two rotary units 50 respectively positioned at the left side and the right side of the soap dispenser assembly 10. As shown in FIG. 1 to FIG. 6, in the above preferred embodiment, the casing 20 includes a tube 21 and a vertical tube 22 which is connected to a front end of the tube body 21. The tube body 21 is a round tube extending in a front-rear direction. The tube body 21 includes two lateral holes 211 positioned at a left side and a right side of the tube body 21. A part of the left side and the right side of the tube body 21 located behind the two lateral holes 211 respectively has a button hole 212. The vertical tube 22 is vertically arranged and an inside of the vertical tube 22 communicates with an inside of the tube body 21. A front surface of the vertical tube 22 has two button through holes 221 respectively positioned at a left side and a right side of the vertical tube 22. The fixed base 71 of the shower bar assembly 70 is positioned right above the soap dispenser assembly 10. The slide bar 72 is connected between a front end of the fixed base 71 and a top end of the vertical tube 22.

The valve core 30 is disposed inside the tube body 21. A top surface and a bottom surface of a front half of the valve core 30 have a fastening slot 33 respectively. Each of the front holes 32 has a front section and a rear section, in which each of the front sections forms an accommodating section 321 and a diameter of the accommodating section 321 is greater than that of the rear section. A rear end of the valve core 30 has an embedding section 34 whose outline of an outer peripheral surface is non-circular. The soap dispensing mechanism 40 is disposed in the tube body 21 and is connected to the front side of the valve core 30. To fasten the two first check valves 41 and the two second check valves 433 to the front side of the valve core 30, the soap dispensing mechanism 40 is provided with a rear fastening member 42 and a front fastening member 44.

Each of the first check valve 41 is a nozzle valve and is disposed in each of the accommodating sections 321. A rear end of each of the first check valves 41 has an annular flange 411 protruding toward around and abutting against a periphery of a rear end of each of the accommodating section 321. The rear fastening member 42 has a rear plate 421 and two rear hooks 424. The rear plate 421 abuts against the front surface of the valve core 30 and has two rear through holes 422 respectively corresponding to the front hole 32. A periphery of each of the rear through holes 423 respectively extends backward to form a rear tube 423 passing through each of the accommodating sections 321 and abutting against each of the annular flanges 411 with an end of each of the rear tubes 423, so that each of the first check valve 41 is fastened in each of the accommodating sections 321. The two rear hooks 424 are connected respectively to a top edge and a bottom edge of the rear plate 421 and extend backward respectively. The two rear hooks 424 hook on the two fastening slots 33 respectively.

The soap dispensing mechanism includes two compressing members 43 respectively corresponding to each of the front holes 32. Each of the compressing members 43 is an elastomer of a high molecular polymer such as rubber, silicone, or plastic. Each of the compressing members 43 has one temporary soap chamber 431 therein. A periphery of a front end of each of the compressing members 43 forms a flange portion 432. Each of the second check valves 433 is a nozzle valve and is respectively connected to a middle of the front end of each of the compressing members 43. A rear end of each of the second check valves 433 communicates with a front end of each of the temporary soap chambers 431. A rear end of each of the compressing members 43 is an open end and has a cover plate 434 protruding toward around. In the current preferred embodiment, the cover plates 434 of the rear end of the two compressing members 43 are connected to form one piece. In another preferred embodiment, the cover plates 434 of the rear end of the two compressing members 43 can be separated from each other. The cover plates 434 sealing cover a front surface of the rear plate 421 so that each of the rear through holes 422 communicate with each of the temporary soap chambers 431.

The front fastening member 44 has a front plate 441 and two front hooks 443. The front plate 441 abuts against a front surface of the cover plate 434 and has two front through holes 442 respectively corresponding to each of the compressing members 43 so that each of the compressing member 43 passes forward through each of the front through hole 442. The two front hooks 443 are connected respectively to a top edge and a bottom edge of the front edge 441 and extend backward respectively. In the current preferred embodiment, the front hooks 443 are a pair of hooks and are located on the left side and the right side of each of the rear hooks 424 to avoid positional interference between each of the front hooks 443 and each of the rear hooks 424. The two front hooks 443 hook on each of the fastening slots 33 respectively.

Each of the pressing members 45 includes a front diversion member 451 and a button 452 which is sleeved on each of the front diversion members 451. Each of the buttons 452 passes forward through each of the button through holes 221 of the vertical tube 22. Each of the front diversion members 451 includes a front diversion hole 4511 therein which has a rear end and a bottom end. Each of the front diversion members 451 has an abutting flange 4512 positioned at a back of each of the front diversion members 451. Each of the abutting flanges 4512 surrounds a periphery of a rear end of each of the front diversion holes 4511. A rear end of each of the front diversion holes 4511 is sleeved on a periphery of each of the second check valves 433. Each of the abutting flanges 4512 abuts against the flange portion 432 positioned at the front end of each of the compressing members 43. A bottom end of each of the front diversion holes 4511 is connected to a liquid outlet tube 453. A bottom end of each of the liquid outlet tubes 453 extends and abuts a bottom end of the vertical tube 22. Each of the liquid outlets 4531 is positioned at a bottom of each of the liquid outlet tubes 453. In the current embodiment, the bottom end of the vertical tube 22 has two openings and each of the liquid outlets 4531 communicate with an outside through the two openings.

A rear end of the tube body 21 is sleeved on a positioning seat 23 for fixing to the wall. An outline of a peripheral surface of the positioning seat 23 conforms to an outline of an inner wall of the rear end of the tube body 21. The two fastening holes of the first fixed structure 231 pass through a back side of the positioning seat 23. The positioning seat 23 is provided with two flexible buttons 232 respectively positioned at the left side and the right side of the positioning seat 23. A front end of the positioning seat 23 forms a positioning groove 233 whose shape conforms to a shape of the embedding section 34. Each of the pivot mechanisms 24 has a fastening ring 241 fixedly embedded in each of the lateral holes 211. Each of the fastening rings 241 has a tube through hole 242 positioned at a middle of each of the fastening rings 241. Each of the fastening rings 241 includes two lateral hooks 243 which are positioned respectively at two opposites sides of a periphery of the tube through hole 242 and extend outward respectively. An extending direction of the two lateral hooks 243 is parallel to a direction of the axis of rotation A.

When the casing 20 is fixed to the wall through the positioning seat 23, the positioning seat is firstly fixed to the wall by means of fastening components passing through the fastening hole of the first fixed structure 231. Then, the rear end of the tube body 21 is sleeved on the positioning seat 23. A rear surface of the positioning seat 23 is aligned front to back with a periphery of the rear end of the vertical tube 22. And, the two flexible buttons 232 are respectively inserted into the two button holes 212 to be fixed, which achieves the effects of rapid installation of the soap dispenser assembly 10 and easy disassembly and maintenance. In another preferred embodiment, it is possible to have one or a plurality of button holes 212 for the same number of the flexible buttons 232 to be inserted, thereby quickly fixing the soap dispenser assembly 10. The embedding section 34 of the valve core 30 is embedded in the positioning groove 233 of the front end of the positioning seat 23, so that the valve core 30 is fixed and does not rotate. With the soap dispensing mechanisms 40 disposed on a front side and a rear side of the valve core 30 and by limiting a position of the positioning seat 23, the valve core 30 is positioned in the tube body 21 between the two lateral holes 211.

Figure 8:
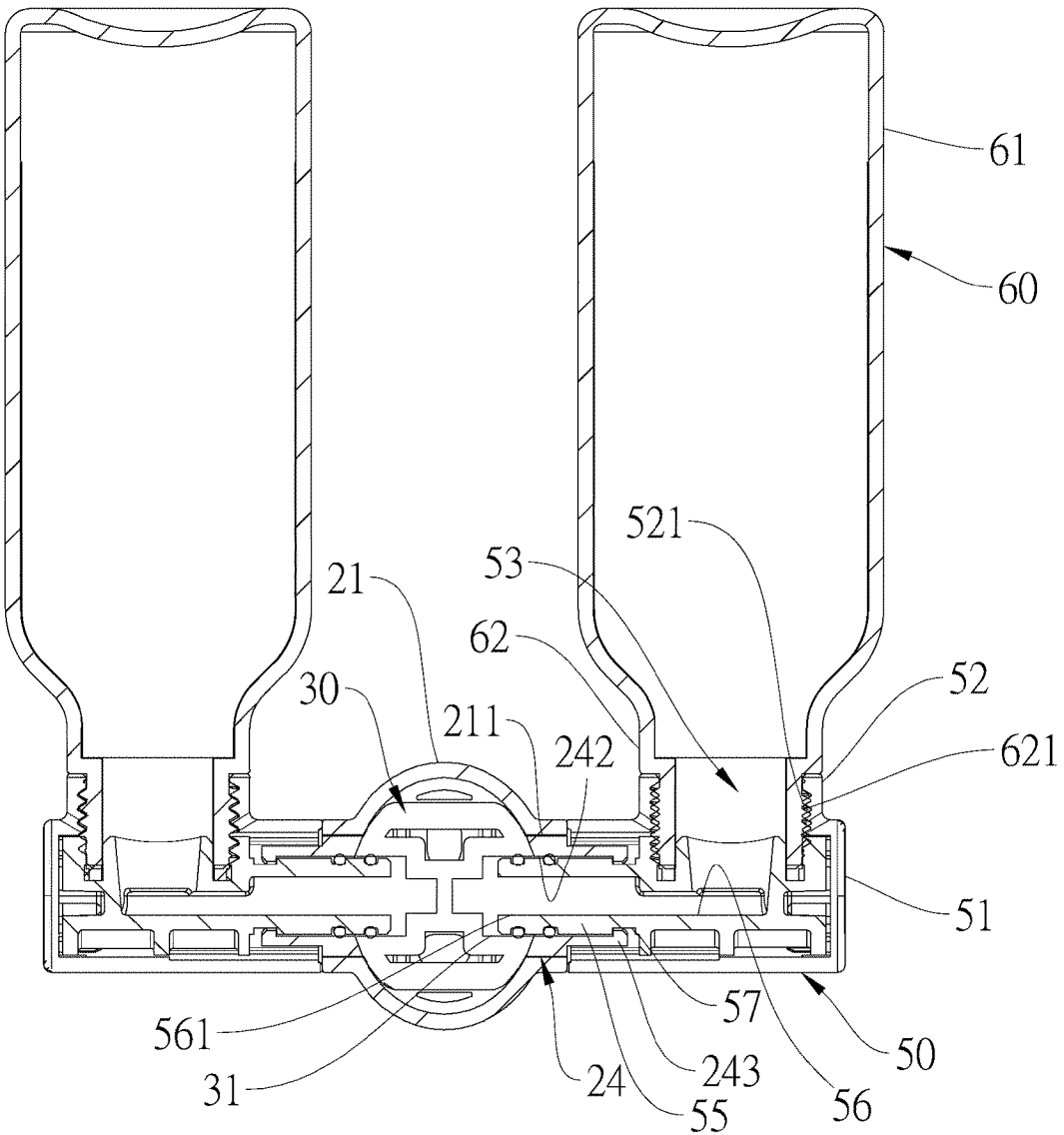
FIG. 8 is a front sectional view of the soap dispenser assembly of the preferred embodiment.

As shown in FIG. 7 to FIG. 8, each of the rotary units 50 includes a rotating casing 51 and a side diversion member 54. A side of each of the rotating casings 51 facing each of the lateral holes 211 has a lateral opening 511. A periphery of each of the rotating casings 51 forms a tubular member 52 which has an inner threaded section 521 on an inner wall of each of the tubular members 52. Each of the soap bottle joint openings 53 is formed on an inner side of each of the inner threaded section 521. Each of the side diversion members 54 is fixed in each of the rotating casings 51 and has a shaft tube 55 which extends toward each of the lateral holes 211 and passes through each of the lateral openings 511. An axis line of each of the shaft tubes 55 overlaps with the axis of rotation A.

Each of the side diversion members 54 has a side diversion hole 56. One end of each of the side diversion holes 56 communicates with each of the soap bottle joint openings 53. Each of the side diversion holes 56 extends to each of the shaft tubes 55 and the other end of each of the side diversion holes 56 forms each of the connecting openings 561 at an outer end of each of the shaft tubes 55. Each of the shaft tubes 55 passes through each of the tube through holes 242 to rotatably insert into each of the side holes 31 of the valve core 30. Each of the shaft tubes 55 has an annular groove 57 which is formed at an outer peripheral surface of a part of each of the shaft tubes 55 that is not inserted into each of the side holes 31. The two lateral hooks 243 of each of the pivot mechanisms 24 hook on each of the annular groove 57 to be positioned.

Each of the soap bottles 60 has a bottle body 61 and a bottleneck 62 which is connected to the bottle body 61. An outer peripheral surface of each of the bottleneck 62 forms an outer threaded section 621 which is screwed to the inner threaded section 521 and is fastened.

The instructions of the detailed structure of the above preferred embodiment are further illustrated. When using, the user presses each of the buttons 452 exposed forwardly on the casing 20. After being pressed, each of the buttons 452 forces each of the front diversion members 451 to move backward to have each of the abutting flanges 4512 abutting against each of the flange portions 432 and compressing backward the volume of each of the compressing members 43 and the space of each of the temporary soap chambers 431. At this time, the liquid soap in each of the temporary soap chambers 431 flows from each of the second check valves 433 through each of the front diversion holes 4511 and each of the liquid outlet tubes 453 to be output from each of the liquid outlets 4531.

When the user releases each of the buttons 452, each of the compressing members 43 and each of the temporary soap chambers 431 therein return to the original state and generate vacuum suction. Due to gravity and vacuum suction, the liquid soap in each of the soap bottles 60 passes through each of the side holes 31, each of the front holes 32, and each of the first check valves 411 and is sucked to each of the temporary soap chambers 431 to be ready for use. As shown in FIG. 9 and FIG. 10, when the liquid soap in each of the soap bottles 60 needs to be refilled or a new soap bottle 60 needs to be replaced, first rotate each of the rotary units 50 to a position where each of the tubular members 52 faces down. After detaching each of the soap bottles 60, have each of the soap bottles 60 containing the liquid soap with the bottle mouths facing upwards to be coupled to each of the tubular members 52 of each of the rotary units 50 in a manner that each of the outer threaded sections 621 is screwed to each of the inner threaded section. Finally, rotate each of the soap bottles 60 together with each of the rotary units 50 to a position where the soap bottles 60 are upside-down and complete the installation of the soap bottles 60.

It must be pointed out that the embodiments described above are only some embodiments of the present invention. All equivalent structures which employ the concepts disclosed in this specification and the appended claims should fall within the scope of the present invention.

What is claimed is:

1. A shower bar system for liquid soap supply, comprising:

a soap dispenser assembly including a soap dispensing mechanism, a first fixed structure, a rotary unit and a soap bottle, and having a lateral hole positioned on at least one side of a left side and a right side, wherein the lateral hole is provided with a pivot mechanism rotatably coupled to the rotary unit, a peripheral surface of the rotary unit has a soap bottle joint opening, a side of the rotary unit facing the lateral hole has a connecting opening communicating with the soap bottle joint opening and the soap dispensing mechanism; the soap bottle for containing liquid soap is detachably coupled to the soap bottle joint opening; and a shower bar assembly including a fixed base, a slide bar, and an accessory, wherein the fixed base has a second fixed structure, the slide bar is connected between the soap dispenser assembly and the fixed base, and the accessory is coupled to the slide bar.

2. The shower bar system for liquid soap supply of claim 1, wherein the soap dispenser assembly further includes a casing and a valve core, the valve core is disposed inside the casing, and the first fixed structure is disposed at a rear end of the casing; the valve core has a side hole corresponding to the lateral hole and positioned on at least one side of a left side and a right side of the valve core, the connecting opening of the rotary unit is in sealing communication with the side hole of the valve core; a front surface of the valve core has at least one front hole communicating with the side hole; the soap dispensing mechanism which is disposed in the casing includes a temporary soap chamber therein, a first check valve, a pressing member and a second check valve; the temporary soap chamber corresponds to the front hole; the first check valve is located between the temporary soap chamber and the front hole; the pressing member corresponds to the temporary soap chamber; when the pressing member is pressed, it compresses the temporary soap chamber to output liquid soap in the temporary soap chamber from a liquid outlet; after the pressing member is not pressed, the temporary soap chamber returns to an original position; the second check valve is located between the liquid outlet and the temporary soap chamber.

3. The shower bar system for liquid soap supply of claim 2, wherein the soap dispensing mechanism includes a compressing member corresponding to the front hole; the compressing member is an elastomer and has the temporary soap chamber therein; a periphery of a front end of the compressing member forms a flange portion; the second check valve is connected to the middle of the front end of the compressing member; the pressing member has a front diversion hole therein, and the front diversion hole has a rear end and a bottom end; the rear end of the front diversion hole is sleeved on the second check valve and abuts against the flange portion; the bottom end of the front diversion hole is connected to a liquid outlet tube; the liquid outlet is positioned at a bottom of the liquid outlet tube.

4. The shower bar system for liquid soap supply of claim 3, wherein a top surface and a bottom surface of the valve core have a fastening slot respectively; the front hole has a front section and a rear section, in which the front section forms an accommodating section and a diameter of the accommodating section is greater than that of the rear section; the first check valve is disposed in the accommodating section; a rear end of the first check valve has an annular flange abutting against a periphery of a rear end of the accommodating section; the soap dispensing mechanism includes a rear fastening member having a rear plate and two rear hooks; the rear plate abuts against the front surface of the valve core and has a rear through hole corresponding to the front hole; a periphery of the rear through hole extends backward to form a rear tube passing through the accommodating section and abutting against the annular flange with an end of the rear tube, so that the first check valve is fastened in the accommodating section; the two rear hooks are connected respectively to a top edge and a bottom edge of the rear plate and extend backward respectively; the two rear hooks hook on the two fastening slots respectively.

5. The shower bar system for liquid soap supply of claim 4, wherein a rear end of the compressing member is an open end and has a cover plate protruding toward around; the cover plate sealing covers the rear plate so that the rear through hole communicates with the temporary soap chamber; the soap dispensing mechanism includes a front fastening member having a front plate and two front hooks; the front plate abuts against a front surface of the cover plate and has a front through hole corresponding to the compressing member so that the compressing member passes forward through the front through hole; the two front hooks are connected respectively to a top edge and a bottom edge of the front plate and extend backward respectively; the two front hooks hook on the two fastening slots respectively.

6. The shower bar system for liquid soap supply of claim 5, wherein the pressing member includes a front diversion member and a button which is sleeved on the front diversion member; the front diversion member includes the front diversion hole and an abutting flange which is at a back of the front diversion hole; the abutting flange surrounds a periphery of the rear end of the front diversion hole and abuts the flange portion.

7. The shower bar system for liquid soap supply of claim 6, wherein the casing includes a tube body and a vertical tube which is connected to a front end of the tube body; the tube body extends forward and backward and has the lateral hole; the valve core and the soap dispensing mechanism are respectively disposed in the tube body; the vertical tube is vertically arranged; an inside of the vertical tube communicates with an inside of the tube body; a front surface of the vertical tube has at least one button through hole; the button passes forward through the at least one button through hole; a bottom end of the liquid outlet tube extends and abuts a bottom end of the vertical tube.

8. The shower bar system for liquid soap supply of claim 7, wherein a part of the tube body located behind the lateral hole has at least one button hole; a rear end of the tube body is sleeved on a positioning seat; an outline of a peripheral surface of the positioning seat conforms to an outline of an inner wall of the rear end of the tube body; the first fixed structure is a fastening hole which passes through the positioning seat; the positioning seat is provided with at least one flexible button which is inserted into the button hole so that the positioning seat is positioned inside the rear end of the tube body.

9. The shower bar system for liquid soap supply of claim 7, wherein the fixed basis positioned above the soap dispenser assembly; the second fixed structure is a fastening hole; the slide bar is connected between the fixed base and the vertical tube.

10. The shower bar system for liquid soap supply of claim 7, wherein the pivot mechanism has a fastening ring fixedly embedded in the lateral hole; the fastening ring has a tube through hole positioned at a middle of the fastening ring; the fastening ring includes two lateral hooks which are positioned respectively at two opposites sides of a periphery of the tube through hole and extend outward respectively; the rotary unit includes a rotating casing and a side diversion member; a side of the rotating casing facing the lateral hole has a lateral opening; a periphery of the rotating casing forms a tubular member which has an inner threaded section on an inner wall of the tubular member; the soap bottle joint opening is formed on an inner side of the inner threaded section; the side diversion member is fixed in the rotating casing and has a shaft tube which extends toward the lateral hole and passes through the lateral opening; the side diversion member has a side diversion hole; one end of the side diversion hole communicates with the soap bottle joint opening; the side diversion hole extends to the shaft tube and the other end of the side diversion hole forms the connecting opening at an outer end of the shaft tube; the shaft tube passes through the tube through hole to rotatably insert into the side hole of the valve core; the shaft tube has an annular groove which is formed at an outer peripheral surface of a part of the shaft tube that is not inserted into the side hole; the two lateral hooks of the pivot mechanism hook on the annular groove.

* * * * *